US007862110B2

(12) United States Patent
Rogers

(10) Patent No.: US 7,862,110 B2
(45) Date of Patent: Jan. 4, 2011

(54) HEADREST FOR RECLINER CHAIR

(75) Inventor: W. Clark Rogers, Denton, NC (US)

(73) Assignee: L & P Property Management Company, South Gate, CA (US)

( * ) Notice: Subject to any disclaimer, the term of this patent is extended or adjusted under 35 U.S.C. 154(b) by 184 days.

(21) Appl. No.: 12/103,329

(22) Filed: Apr. 15, 2008

(65) Prior Publication Data

US 2008/0258512 A1 Oct. 23, 2008

Related U.S. Application Data

(60) Provisional application No. 60/913,054, filed on Apr. 20, 2007.

(51) Int. Cl.
*A47C 1/02* (2006.01)
*A47C 7/36* (2006.01)

(52) U.S. Cl. ..... 297/61; 297/391; 297/396; 297/403

(58) Field of Classification Search ..... 297/61, 297/391, 396, 403
See application file for complete search history.

(56) References Cited

U.S. PATENT DOCUMENTS 2,884,992 A * 5/1959 Spound et al. ..... 297/61
3,140,117 A * 7/1964 Fletcher ..... 297/61
5,310,243 A * 5/1994 Pine ..... 297/61
5,340,191 A * 8/1994 May ..... 297/61
5,346,277 A * 9/1994 Holobaugh et al. ..... 297/61
5,374,100 A * 12/1994 Rogers et al. ..... 297/61
7,201,438 B2 * 4/2007 Reinsch et al. ..... 297/61

* cited by examiner

*Primary Examiner*—Sarah B McPartlin
(74) *Attorney, Agent, or Firm*—Shook, Hardy & Bacon L.L.P.

(57) ABSTRACT

A reclining seating unit includes: a seat; a backrest, the backrest including a frame having a top edge; a reclining mechanism attached to the seat and backrest that moves the seat and backrest between upright and reclined positions; a headrest including a headrest panel; and a headrest mechanism attached to the backrest and the headrest. The headrest mechanism comprises a plurality of pivotally interconnected links and is configured to move the headrest between a retracted position, in which the headrest panel is generally horizontally disposed and overlies the top edge of the backrest frame, and an extended position, in which the headrest panel is vertically disposed and is separated from the top edge of the backrest frame. Movement of the seating unit from the upright position to a reclined position moves the headrest from the retracted position to the extended position. The headrest mechanism comprises: a connecting link pivotally connected to the reclining mechanism; a rear extension link pivotally connected to the connecting link; a front extension link pivotally and slidably connected to the connecting link; a headrest mounting bracket mounted to the headrest panel, the headrest mounting bracket being pivotally interconnected to the front and rear extension links; and a control link pivotally interconnected with the backrest frame, the front extension link and the connecting link. In this configuration, the seating unit can include a headrest that can be employed with chair styles that have a relatively low and narrow backrest.

14 Claims, 4 Drawing Sheets

HEADREST FOR RECLINER CHAIR

RELATED APPLICATION

This application claims priority from U.S. Provisional Patent Application No, 60/913,054, filed Apr. 20, 2007, the disclosure of which is hereby incorporated herein in its entirety.

FIELD OF THE INVENTION

The invention relates generally to seating units, and more specifically to seating units with headrests.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest or ottoman that provides support for the occupant's feet in the reclined position.

One particularly popular recliner is the "three-way" recliner, which has two reclined positions: an intermediate "TV position", in which the footrest or ottoman of the chair is projected forwardly from the chair while the backrest remains substantially upright relative to the seat; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position, and from a "one-way" recliner, which typically has no intermediate "TV" position.

One recliner chair feature that has become popular in some models is a headrest that is retracted when the recliner chair is in its upright position and extends when the reclining chair moves to a reclined position. Such a headrest can provide support for the occupant's head, which may increase comfort for a reclining occupant, particularly in chairs in which styling demands a relatively low backrest. An exemplary headrest is described and illustrated in U.S. Pat. No. 5,346,277 to Holobaugh et al. The chair illustrated therein includes a headrest that is generally horizontally disposed atop the backrest when the chair is in the upright position and generally vertically disposed above the backrest when the chair is in a reclined position. A headrest that folds within a cavity in the rear surface of the backrest, then inverts as it extends, is illustrated in U.S. Pat. No. 3,652,125 to Rogers. The disclosures of each of these patents are hereby incorporated herein by reference.

As chair styling continues to evolve, it may be desirable to provide additional headrest configurations, particularly for certain types of chairs for which styling concerns dictate the size and shape of the backrest.

SUMMARY OF THE INVENTION

As a first aspect, embodiments of the present invention are directed to a reclining seating unit, comprising: a seat; a backrest, the backrest including a frame having a top edge; a reclining mechanism attached to the seat and backrest that moves the seat and backrest between upright and reclined positions; a headrest including a headrest panel; and a headrest mechanism attached to the backrest and the headrest. The headrest mechanism comprises a plurality of pivotally interconnected links and is configured to move the headrest between a retracted position, in which the headrest panel is generally horizontally disposed and overlies the top edge of the backrest frame, and an extended position, in which the headrest panel is vertically disposed and is separated from the top edge of the backrest frame. Movement of the seating unit from the upright position to a reclined position moves the headrest from the retracted position to the extended position. The headrest mechanism comprises: a connecting link pivotally connected to the reclining mechanism; a rear extension link pivotally connected to the connecting link; a front extension link pivotally and slidably connected to the connecting link; a headrest mounting bracket mounted to the headrest panel, the headrest mounting bracket being pivotally interconnected to the front and rear extension links; and a control link pivotally interconnected with the backrest frame, the front extension link and the connecting link. In this configuration, the seating unit can include a headrest that can be employed with chair styles that have a relatively low and narrow backrest.

As a second aspect, embodiments of the present invention are directed to a reclining seating unit, comprising: a seat; a backrest, the backrest including a frame having a top edge; a reclining mechanism attached to the seat and backrest that moves the seat and backrest between upright and reclined positions, the reclining mechanism including a seat link that supports the seat from underneath; and a headrest including a headrest panel; and a headrest mechanism attached to the backrest and the headrest. The headrest mechanism comprises a plurality of pivotally interconnected links and is configured to move the headrest between a retracted position, in which the headrest panel is generally horizontally disposed and overlies the top edge of the backrest frame, and an extended position, in which the headrest panel is vertically disposed and is separated from the top edge of the backrest frame. Movement of the seating unit from the upright position to a reclined position moves the headrest from the retracted position to the extended position. The headrest mechanism is attached to an actuating unit of the reclining mechanism, the actuating mechanism comprising a cross-tube that extends transversely through the seat link and a finger fixed to the cross-tube. The headrest mechanism includes a transition link pivotally connected to the finger, and a drive link pivotally connected with the seat link, with the transition link, and with a lower end of the connecting link at respective first, second and third pivots. In this configuration, the headrest mechanism can be employed with and retrofit to an existing reclining mechanism.

As a third aspect, embodiments of the present invention are directed to a reclining seating unit, comprising: a seat; a backrest, the backrest including a frame having a top edge; a reclining mechanism attached to the seat and backrest that moves the seat and backrest between upright and reclined positions, the reclining mechanism including a seat link that supports the seat from underneath and a transition link pivotally attached to the seat link; a headrest including a headrest panel; and a headrest mechanism attached to the backrest and the headrest. The headrest mechanism comprises a plurality of pivotally interconnected links and is configured to move the headrest between a retracted position, in which the headrest panel is generally horizontally disposed and overlies the top edge of the backrest frame, and an extended position, in which the headrest panel is vertically disposed and is separated from the top edge of the backrest frame. Movement of the seating unit from the upright position to a reclined position moves the headrest from the retracted position to the extended position. The headrest mechanism is coupled to the reclining mechanism with a drive link that is pivotally connected to the transition link, to a control link, and to a lower end of the connecting link at respective first, second and third pivots, the control link being pivotally connected to the seat link. In this configuration, the headrest mechanism can be employed with and retrofit to other existing reclining mechanisms.

DETAILED DESCRIPTION OF EMBODIMENTS OF THE INVENTION

Figure 1:
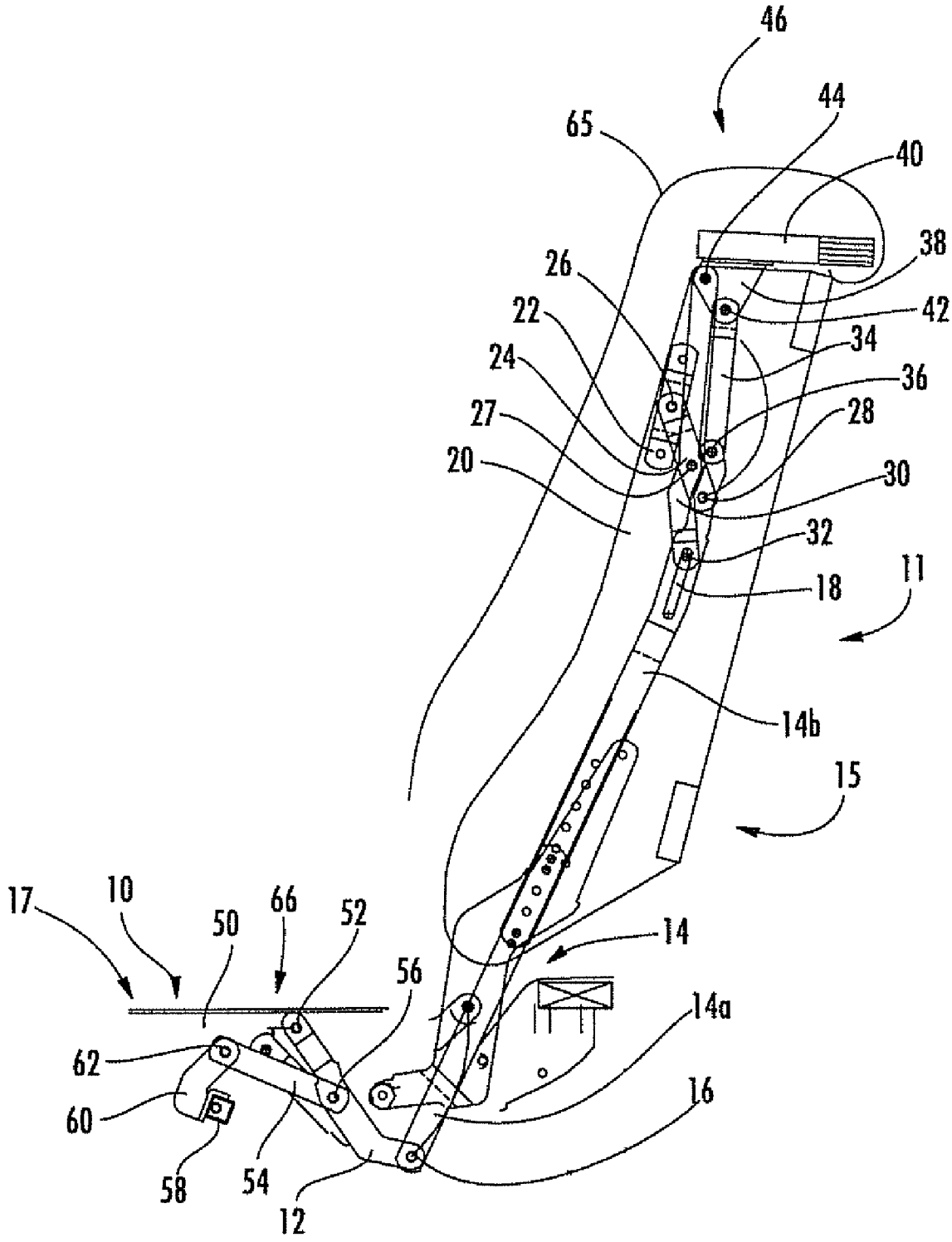
FIG. 1 is a side section view of a headrest extension mechanism according to embodiments of the present invention, with the headrest shown in a lowered position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating unit between its armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The headrest unit illustrated and described herein comprises a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a reclining chair, designated broadly at 10, is illustrated in FIG. 1. The reclining chair 10 will be described first in its upright position, in which a headrest 46 is shown in a lowered (or retracted) position relative to the backrest 15. Movement of the headrest 46 from the lowered position of FIG. 1 to a raised (or extended) position shown in FIG. 2 will subsequently be described. A single piece of upholstery 65 covers the backrest 15 and the headrest 46.

Referring again to FIG. 1, the reclining chair 10 includes a headrest mechanism 11 that is interconnected with the remainder of the reclining mechanism via a headrest drive link 12. A connecting link 14, which includes both an upper portion **14*b* and a lower portion 14*a*, is connected to the rear end of the headrest drive link 12 at a pivot 16. A mounting bracket 22 is fixed to a backrest frame 20 within the backrest 15. A control link 24 is pivotally attached to the mounting bracket 22 at pivot 26 and extends downwardly and rearwardly therefrom to terminate at a pivot 28 with the upper portion 14***b* of the connecting link 14. A front extension link 30 is attached to the upper portion 14*b* of the connecting link 14 via a pin 32 that is received in a slot 18 in the upper portion 14*b* of the connecting link 14 and is slidable and pivotable therein; in addition, the front extension link 30 is attached to the control link 24 at a pivot 27 located between the pivots 26 and 28. Also, a rear extension link 34 is attached via a pivot 36 to the upper end of the connecting link 14, such that the pivot 28 is located between the slot 18 and the pivot 36. A mounting bracket 38 is mounted to the underside of a backrest panel 40. The mounting bracket 38 is attached to the upper end of the front extension link 30 at a pivot 44 and to the upper end of the rear extension link 34 at a pivot 42; the pivot 44 is positioned slightly higher than and forwardly of the pivot 42.

Referring still to FIG. 1, the headrest drive link 12 is connected to a seat link 50 at a pivot 52 and extends rearwardly and downwardly therefrom to the pivot 16 with the connecting link 14. A transition link 54 is connected to an intermediate portion of the headrest drive link 12 at a pivot 56 and extends rearwardly and slightly upwardly therefrom. A cross-tube 58 extends transversely across the chair 10 and is connected to a handle (not shown). A finger 60 is fixed to a forward surface of the cross-tube 58 and extends upwardly and rearwardly therefrom to terminate at a pivot 62 with the rear end of the transition link 54. The cross-tube 58 and finger 60 comprise the actuating portion of the reclining mechanism 66 of the chair 10.

Figure 2:
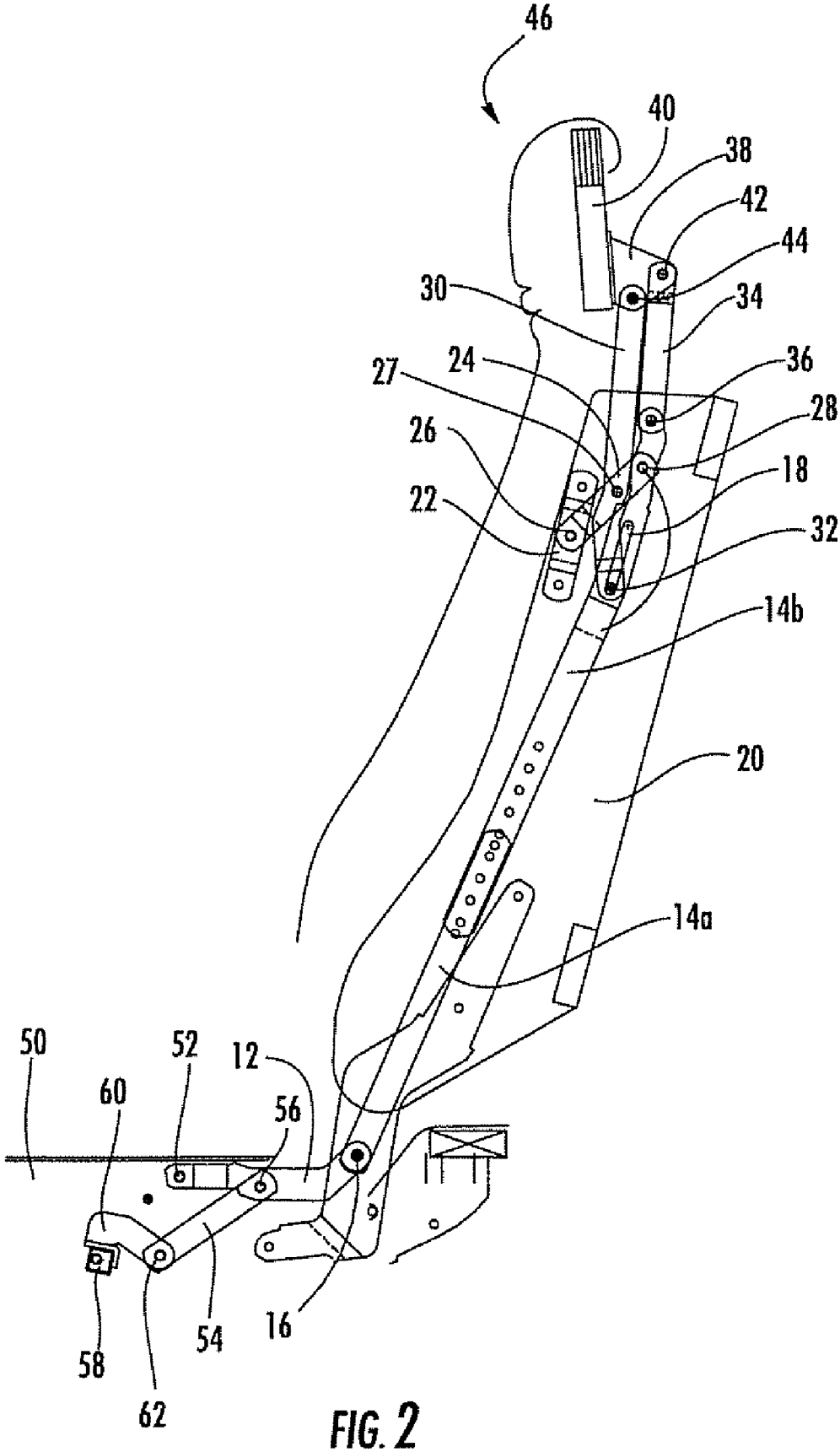
FIG. 2 is a side section view of the headrest extension mechanism of FIG. 1, with the headrest shown in a raised position.

The headrest 46 moves from its lowered position in FIG. 1 to its raised position in FIG. 2 as the reclining chair 10 moves from an upright position to a "TV" position, in which the footrest is extended, but the seat 17 and backrest 15 maintain substantially the same angle relative to each other. Movement from the upright position to the TV position is effected by rotation of the handle (not shown) in a clockwise direction from the vantage point of FIG. 1 to actuate the actuating portion of the reclining mechanism 66. This rotation causes the crosstube 58 to rotate clockwise, which in turn drives the finger 60 clockwise. This action forces the transition link 54 rearwardly, which drives the headrest drive link 12 counterclockwise about the pivot 52. Rotation of the headrest drive link 12 causes its rearward end to rise, which forces the connecting link 14 upwardly. Because the remainder of the reclining mechanism maintains the seat 17 and backrest 15 in substantially the same relative positions, the connecting link 14 moves upwardly relative to the mounting bracket 22. As the connecting link 14 rises, it forces the rear extension link 34 upwardly; however, the front extension link 30 lags behind, its movement being controlled by the slot 18 and the control link 24. Because the rear extension link 34 rises more than does the front extension link 30, the pivot 42 rises more than does the pivot 44, which causes the mounting bracket 38 to rotate counterclockwise, thereby rotating the headrest panel 40 also (see FIG. 2). Movement ceases when the footrest mechanism (not shown) fully extends the footrest (also not shown), which locks in the headrest mechanism 11 (and, in turn, the headrest 46) in the raised position.

The headrest 46 can be returned from the raised position of FIG. 2 to the lowered position of FIG. 1 by returning the footrest to a retracted position.

The headrest mechanism 11 can be employed with a number of different recliner chair styles, but may be particularly suitable for use with chairs with low backrests and/or relatively thin backrests. The interaction between the connecting link 14 and the front and rear extension links 30, 34 (as controlled by the control link 24) enables the headrest 46 to extend and separate a significant distance from the backrest frame 20 in a relative narrow (as measured front to back) space in the backrest 13. For example, the headrest mechanism 11 may be suitable for use in a chair in which the backrest 13 is less than 5 inches in depth and/or when it is desirable that the headrest 46 separate from the top edge of the backrest frame 20 at least 2 inches when the headrest 46 is in the extended position.

Figure 3:
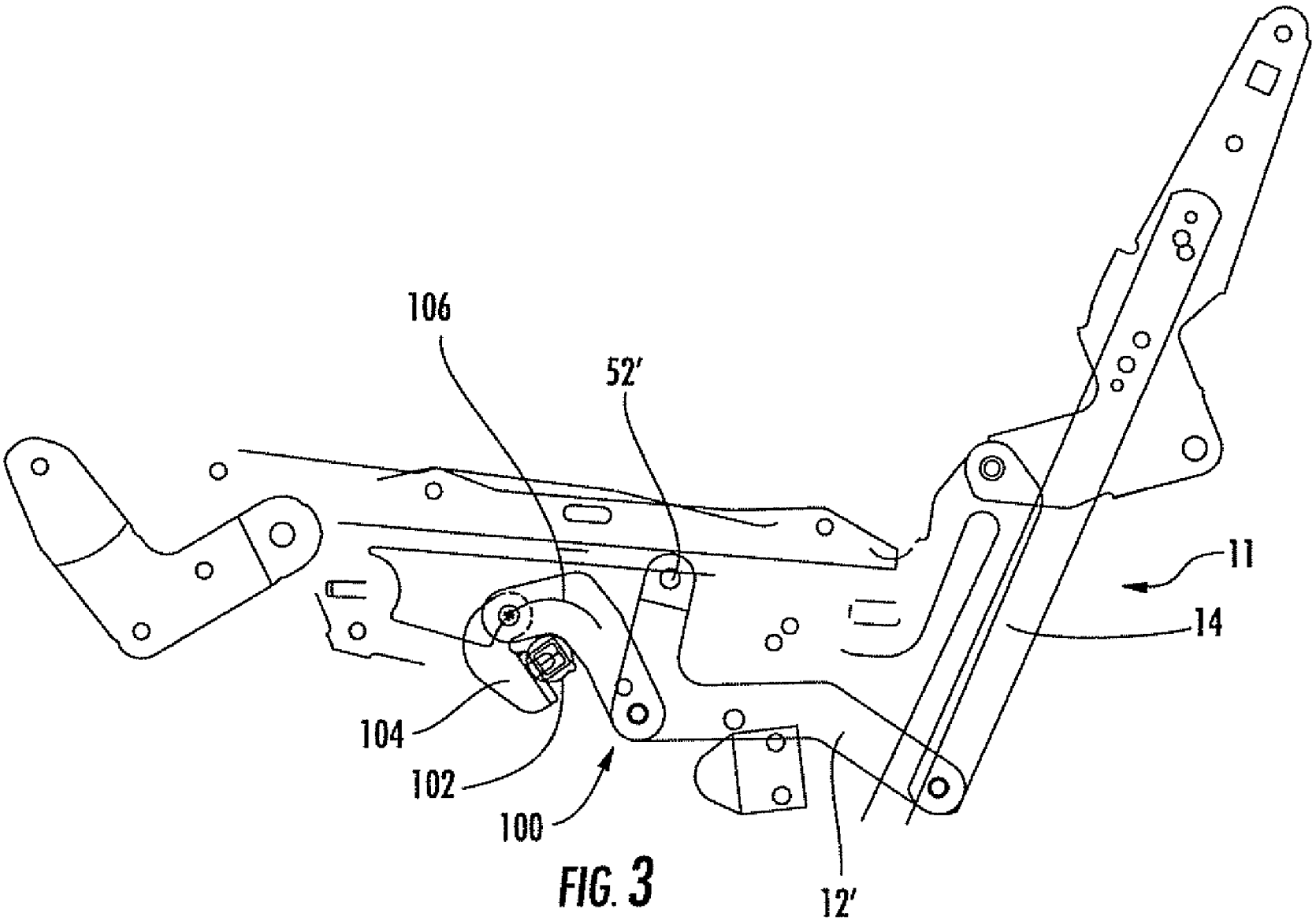
FIG. 3 is a side section view of the connecting link of the headrest extension mechanism shown in FIG. 1 attached to a wall proximity reclining chair.

Those skilled in this art will appreciate that the headrest mechanism 11 may be suitable for use with other recliner chairs and recliner mechanisms. For example, although the recliner chair 10 is a high leg, wall proximity unit, FIG. 3 illustrates how the headrest mechanism 11 can be interconnected with a different wall proximity unit through an assembly 100 that is pivotally interconnected to the actuation unit of the chair. Rotation of a handle (not shown) fixed to a cross-tube 102 rotates a finger 104 that is pivotally attached to the headrest assembly 11 through a transition link 106 (the finger 104 and the transition link 106 wrap around the cross-tube 102 when the chair is in its upright position). Rotation of the cross-tube 102 forces the transition link 106 rearwardly, which in turn pivots a tripartite headrest drive link 12' about a pivot 52'. Rotation of the headrest drive link 12' then drives the connecting link 14 upwardly in the manner described above.

Figure 4:
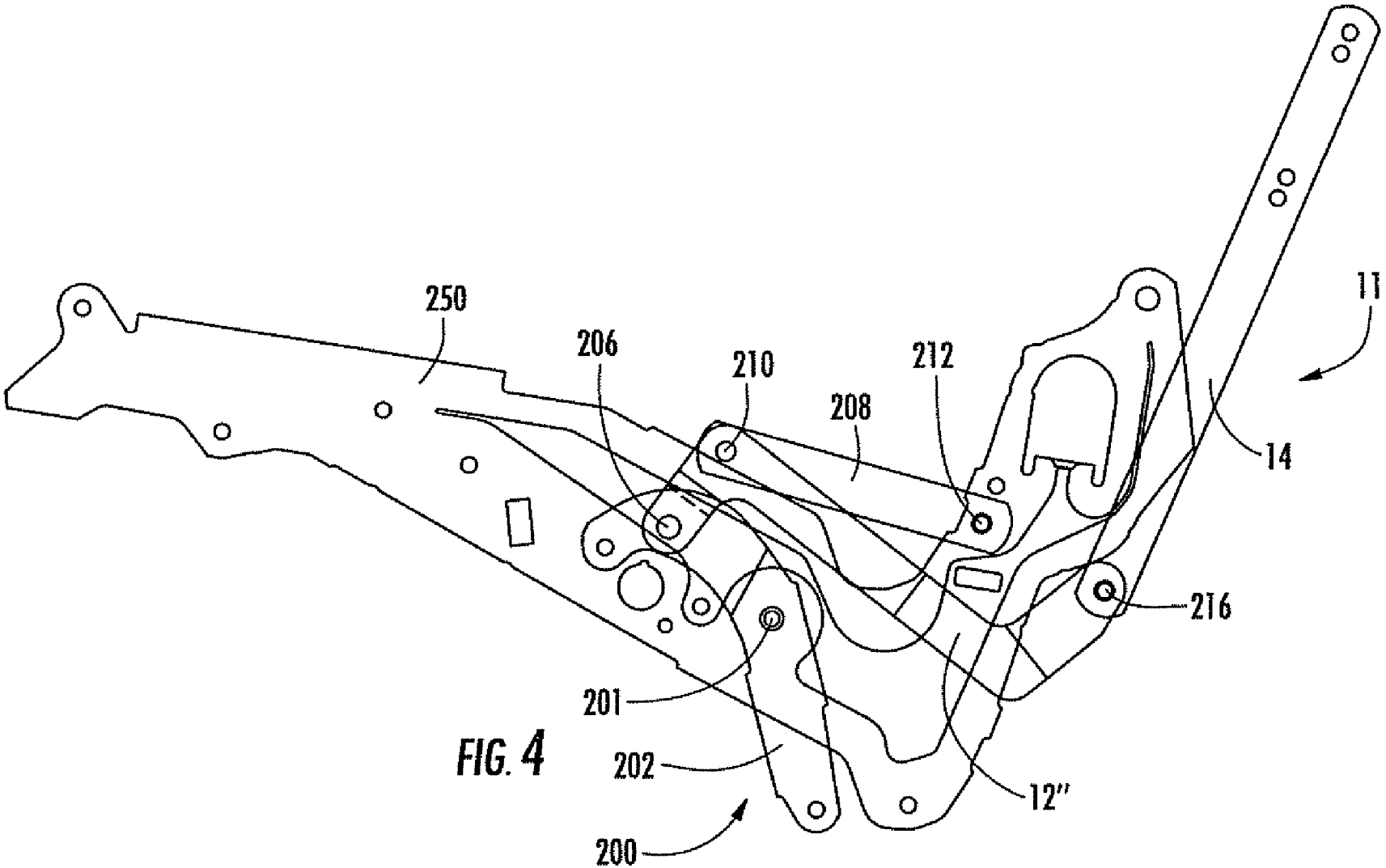
FIG. 4 is a side section view of the connecting link of the headrest extension mechanism shown in FIG. 1 attached to a zero wall proximity reclining chair.

FIG. 4 shows a somewhat similar arrangement for interconnecting the headrest assembly 11 to the reclining mechanism of a zero wall proximity chair. An assembly 200 includes a seat link 250. A J-shaped transition link 202 is pivotally mounted to the seat link 250 at a pivot 201. The transition link 202 is a part of the reclining mechanism that both assists in forcing the ottoman to an extended position and serves in the wall-avoidance portion of the mechanism. A tripartite headrest drive link 12" is pivotally attached at its forward end to the transition link 202 at a pivot 206, and is further pivotally attached to the connecting link 14 at a pivot 216. A control link 208 is attached at its front end to a vertex of the headrest drive link 12" at a pivot 210 and at its rear end to the seat link 250 at a pivot 212. When the chair is moved from the upright position to the TV position, the footrest mechanism (not shown) attached to the lower end of the transition link 202 drives the transition link 202 clockwise about the pivot 201. This rotation drives the headrest drive link 12" upwardly and slightly counterclockwise about the pivot 210, and also drives the control link 208 first clockwise, then counterclockwise about the pivot 212. The upward motion and rotation of the headrest drive link 12" causes the connecting link 14 to rise and extend the headrest to the raised position.

The headrest mechanism 11 can be used with other reclining mechanisms, including those shown in U.S. patent application Ser. No. 11/954,277, filed Dec. 12, 2007, the disclosure of which is hereby incorporated herein in its entirety.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention.

That which is claimed is:

1. A reclining seating unit, comprising:

a seat;

a backrest, the backrest including a frame having a top edge;

a reclining mechanism attached to the seat and backrest that moves the seat and backrest between upright and reclined positions;

a headrest including a headrest panel;

a headrest mechanism attached to the backrest and the headrest, the headrest mechanism comprising a plurality of pivotally interconnected links and configured to move the headrest between a retracted position, in which the headrest panel is generally horizontally disposed and overlies the top edge of the backrest frame, and an extended position, in which the headrest panel is vertically disposed and is separated from the top edge of the backrest frame;

wherein movement of the seating unit from the upright position to a reclined position moves the headrest from the retracted position to the extended position; and wherein the headrest mechanism comprises:

a connecting link pivotally connected to the reclining mechanism;

a rear extension link pivotally connected to the connecting link;

a front extension link pivotally and slidably connected to the connecting link;

a headrest mounting bracket mounted to the headrest panel, the headrest mounting bracket being pivotally interconnected to the front and rear extension links; and a control link pivotally interconnected with the backrest frame, the front extension link and the connecting link;

wherein the connecting link is attached to the reclining mechanism at a pivot, the pivot being positioned below an upper surface of the seat when the seating unit is in the upright position.

2. The seating unit defined in claim 1, wherein the connecting link includes a slot, and the front extension link includes a pin received in the slot, the pin able to slide and pivot within the slot.

3. The seating unit defined in claim 1, wherein a single piece of upholstery covers the backrest and the headrest.

4. The seating unit defined in claim 1, wherein the headrest mechanism includes a headrest drive link pivotally connected to a seat link that supports the seat from underneath and with an actuating portion of the reclining mechanism.

5. The seating unit defined in claim 1, wherein the headrest mechanism further comprises a mounting bracket fixed to the backrest frame, the control link being pivotally connected to the mounting bracket.

6. The seating unit defined in claim 5, wherein the connecting link connects with the control link at a first pivot, with the front extension link at a slot, and with the rear extension link at a second pivot, and wherein the first pivot is positioned between the second pivot and the slot.

7. The seating unit defined in claim 6, wherein the control link is connected to the backrest mounting bracket at a fifth pivot and to the front extension link at a sixth pivot, and wherein the sixth pivot is positioned between the first pivot and the fifth pivot.

8. The seating unit defined in claim 1, wherein the front extension link connects with the headrest mounting bracket at a third pivot, and the rear extension link connects with the headrest mounting bracket at a fourth pivot, and wherein in the retracted position the third pivot is positioned above the fourth pivot, and in the extended position the fourth pivot is positioned above the third pivot.

9. The seating unit defined in claim 1, wherein the backrest has a top portion that is less than 5 inches in depth.

10. The seating unit defined in claim 1, wherein the headrest panel rises at least 2 inches when moving from the retracted to the extended position.

11. A reclining seating unit, comprising:

a seat;

a backrest, the backrest including a frame having a top edge;

a reclining mechanism attached to the seat and backrest that moves the seat and backrest between upright and reclined positions, the reclining mechanism including a seat link that supports the seat from underneath;

a headrest including a headrest panel;

a headrest mechanism attached to the backrest and the headrest, the headrest mechanism comprising a plurality of pivotally interconnected links and configured to move the headrest between a retracted position, in which the headrest panel is generally horizontally disposed and overlies the top edge of the backrest frame, and an extended position, in which the headrest panel is vertically disposed and is separated from the top edge of the backrest frame;

wherein movement of the seating unit from the upright position to a reclined position moves the headrest from the retracted position to the extended position; and wherein the headrest mechanism is attached to an actuating unit of the reclining mechanism, the actuating mechanism comprising a cross-tube that extends transversely through the seat link and a finger fixed to the crosstube, the headrest mechanism including a transition link pivotally connected to the finger, and a drive link pivotally connected with the seat link, with the transition link, and with a lower end of a connecting link at respective first, second and third pivots.

12. The seating unit defined in claim 11, wherein the finger and the transition link wrap around the crosstube when the seating unit is in its upright position.

13. The seating unit defined in claim 12, wherein the drive link is a tripartite link, and wherein the second pivot is below the third pivot when the seating unit is in the upright position.

14. The seating unit defined in claim 11, wherein the second pivot is above the third pivot when the seating unit is in the upright position.

* * * * *